US005996853A

United States Patent [19]

Julius

[11] Patent Number: 5,996,853

[45] Date of Patent: Dec. 7, 1999

[54] PUTTY INJECTION TOOL

[76] Inventor: Terry L. Julius, 1179 N. 1330 E, Shelley, Id. 83274

[21] Appl. No.: 09/081,851

[22] Filed: May 19, 1998

[51] Int. Cl.[6] ..... B67D 5/06

[52] U.S. Cl. ..... 222/191; 222/386

[58] Field of Search ..... 222/340, 386, 222/391, 191

[56] References Cited

U.S. PATENT DOCUMENTS 4,083,477 4/1978 Zetterberg ..... 222/386

4,869,400 9/1989 Jacobs ..... 222/391 X

*Primary Examiner*—Gregory L. Huson

[57] ABSTRACT

A putty injection tool that is hand held and injects one shot of putty or filler material at a time into a void such as a hole left from setting a nail. The tool is cradled in the curve of the fingers with the hollow tube tip protruding past the fingers. This tool does not hold a cartridge of putty but is loaded each time with putty by pressing the hollow tip into a color matching stick of pliable putty. The tip of the hollow tube is placed against the surface of the void to be filled and the solid shaft is pressed through the hollow shaft to push out the plug of putty into the void. The tool has different sizes and shapes of hollow shafts to allow filling round nail set voids and elongated staple or T-nail voids.

7 Claims, 1 Drawing Sheet

PUTTY INJECTION TOOL

BACKGROUND OF THE INVENTION

This invention pertains to a hand held and operated dispenser tool used for injecting various putty type filler materials into voids such as left from setting a finish nail or fastener below a material surface. This simple machine can inject putty of various consistencies, colors, and material bases into voids without an overflow or smearing onto the surface of the materials.

This putty injection tool pertains to other type putty or caulking guns or viscous fluid dispensers prior art such as U.S. Pat. Nos. (348,811), (382,456), (4,065,034), (5,022,563), (4,869,400), and (4,083,477) for cylindrical main body but differs in such that this tool does not use a cartridge or store a said volume of dispensed material for multiple injections. The putty injection tool injects a single shot of putty into a void and has to be refilled which allows easy installation of different colors of putty or filler materials into voids without replacing any cartridges. This putty injection tool is used in conjunction with already marketed colored putty sticks, caulks, and filler materials. These filler materials are used to fill voids in natural wood, wood facsimiles, laminates, metal, and other surfaces to provide a blemish free, smooth surface thus hiding the fasteners used to construct, assemble, or anchor the materials together.

Many skilled carpenters use color absorbing, hardening, putty or filler to fill a void in the surface of wood or other materials. When the hardened putty is sanded and finished, it provides a blemish free surface and hides the assembly fasteners. Today's construction industry has furnished the market with many prefinished materials such as wood trims or wood facsimile trims, moldings, and sheet materials. These materials are easier to use by the non-skilled handyman. The handyman will often use prefinshed wood trims, laminated sheet goods, and moldings made of wood, plastics, and metals. A handyman will often use a precolored, moldable putty or filler material to fill voids left from setting fasteners below the surface of the material.

Prefinshed materials often cannot be sanded, stained, or finished after the fasteners are installed without damaging the finish and causing a larger blemish in the prefinshed materials. This putty injection tool allows an operator to install color matching putty into a void left by a recessed fastener cleanly, neatly, and without waste or overfill. The putty color can be quickly changed from void to void to match the different color of materials such as light and dark wood grains. This tool allows the operator close control of the volume of putty to be injected with no over flow to surrounding surfaces which minimizes cleaning or contamination of the finished surface. This tool allows a handy man to utilize prefinshed materials and easily install color matching putty to hide recessed fasteners and provide a blemish free surface in the prefinshed materials.

SUMMARY OF THE INVENTION

The primary object of the present invention is to provide a simple, putty injection tool to be used on prefinshed building materials to fill voids in a clean and neat manner without overflow onto the finished surface. The voids in these building materials are usually a result of setting fasteners below the material surface to hide the fastener. The injection of the putty into the void allows the material fasteners to be hidden or covered and assists to provide a blemish free, finished surface.

Other object of the present invention is to make it easy, fast and simple to use precolored putty sticks matched to the color of the finished materials. The use of this simple, one shot type injection tool allows the use of multiple colors of putties to be rapidly installed without changing a tube or cartridge holding a large volume of putty or caulk. The present invention can cleanly deliver a very small volume of putty. The amount of putty is easily controlled to minimize the over flow onto the finished material surface. This putty injection tool has a small tip opening and tube size such that the putty filled tip can be inserted directly into a void and allow little or no spread or overflow onto the finished surface.

This present invention is, therefore, a hand held and operated putty injection tool. The tool handle is held in the inside curve of the fingers and the putty injection tool tube protrudes between the fingers. Inside the tube is a solid shaft that when pushed forward through the tube, will eject a plug of putty out the open tip of the tube. The plug of putty is pressed into the empty and open tube by imbedding the tip of the tube into a putty stick material or other pliable putty. The tube tip, when filled with putty, is then placed perpendicular onto or into a void to be filled. The solid shaft is pressed through the tube by the force of a thumb, finger, or heel of the hand and the putty material is ejected out the tube tip and pressed into the void. The thumb, finger, or heel of the hand is protected from the solid shaft by a concave knob attached to the solid shaft. Pressing the knob down toward the tube will cause the solid shaft to slide through the tube and thus eject a plug of putty in the tip of the tube. A compression spring is loose fit around the solid shaft and tube assembly and is contained between the knob and handle. The solid shaft is returned to loading position by the expansion of the compression spring to allow refilling of the putty injection tool for another operation. The tube and solid shaft are close fitting to minimize creep of putty around and past the solid shaft.

The action of filling the injection tool tip is necessary each time the putty is ejected from the tool such as when filling multiple voids or adding a small amount to complete filling a void flush to the surface. The solid shaft can be held down to extend past the open tip of the tube. The solid shaft can be used to tamp the putty down into the void and pack it full when it is held down and extends past the tip of the tube.

DESCRIPTION OF PREFERRED EMBODIMENTS

Figure 1:
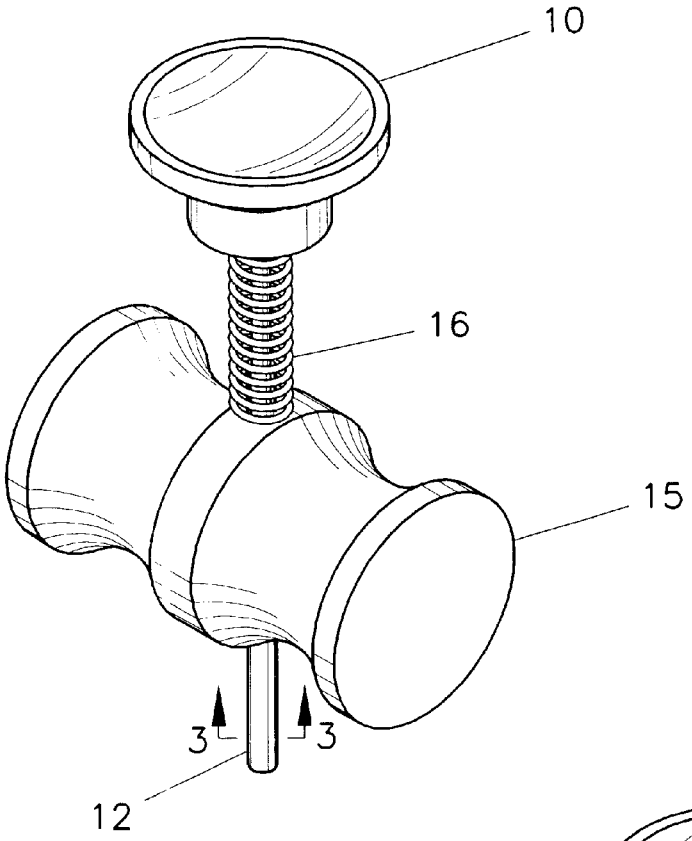
FIG. 1 is an assembled perspective view of the first preferred embodiment of the putty injection tool in accordance with the present invention, and shows the tool in the loading position.

Referring to the drawing and figures, wherein the referenced numerals designate like and corresponding parts throughout the figures. There is shown in FIG. 1 the putty injection tool consisting of the knob 10 which is concave on top to assist the thumb or finger from slipping off. The knob 10 is attached to the straight solid shaft 11 that is inserted into the straight tube 12. The solid shaft 11 and tube 12 have a close fit allowing minimal slippage of putty material between the components. The putty injection tool is operated when the solid shaft 11 is pushed through the tube 12 by being pressed upon via the knob 10. The return compression spring 16 is loose fit around the tube 12 and solid shaft 11, and is to assist solid shaft 11 to return into the loading position by decompressing and pushing against the knob and pulling the solid shaft 11 out of the tube leaving the open tip of the tube 12 empty. The handle 15 is shaped to fit into the curve of the fingers of a persons hand by having wide concave grooves around the circumference of the handle 15. The tube 12 is fixed into and through the handle 15 such that the open tip of the front portion of the tube 12 protrudes out past a person's fingers allowing the tip of the tube 12 to be pressed against a material surface. The tube 12 protrudes through the handle 15 on both front and back sides of the handle. The solid shaft 11 length is longer than the tube 12 to allow space for the compression spring 16 and also to protrude out the front end of the tube 12 when fully depressed. The portion of the tube 12 located between the push knob 10 and the handle 15 acts as a stop for the push knob 10 when depressed and allows space for the compression spring coils when compressed.

Figure 2:
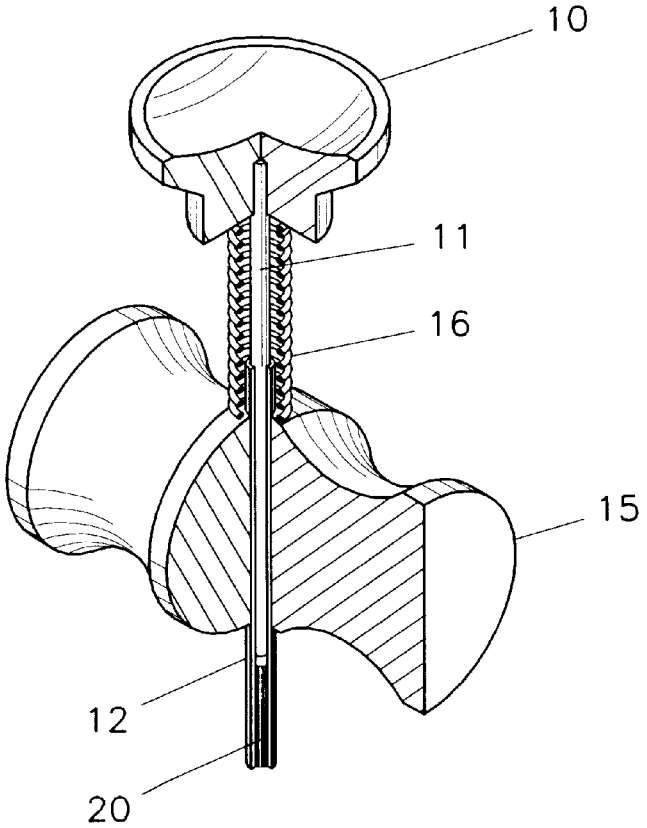
FIG. 2 is an assembled perspective view with a ¼ section cut away to display the assembly of the components with a plug of putty installed in the tip of the tube.

There is shown in FIG. 2 the putty injection tool consisting of the components as described in FIG. 1 and addition of component 20 which is a plug of putty loaded into the tip of the tube 12. The putty injection tool is operated holding the handle 15 in the inside curve of the fingers. When the solid shaft 11 is caused to move through the tube 12 via the knob 10 being pressed upon by the hand or finger, the compression spring 16 is compressed and the solid shaft 11 pushes out a plug of putty 20. When the knob 10 is released, the compression spring 16 returns the solid shaft 11 to the loading position.

Figure 3:
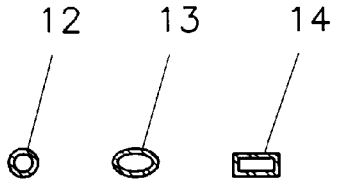
FIG. 3 is a section of alternative shapes or differing sizes of injection tubes and solid shafts.

There is shown in FIG. 3 sections of alternate exterior shapes of the straight tube. The round tube 12, the oval tube 13, and the rectangular tube 14. Each tube will have a matching center shaft of similar shape and close fit to prevent slippage of putty material between the two components.

From the foregoing disclosure those skilled and unskilled in the art of filling of voids in construction materials left from setting fasteners below the finished surface will appreciate the simplicity of the invention, directness of operation, and ease of installation of putty or other filler materials into small voids without overfill, smearing, spreading, or causing a large blemish on the surfaces of construction materials such as prefinished trims or moldings.

What is claimed:

1. A putty injection tool is a hand held tool to be used for injecting a plug of pliable putty or filler material into a void to be filled and said tool is constructed of an elongated handle with concave grooves cut around the circumference, of which said handle is to be held in the cradle of the fingers when the fingers of an open hand are slightly curled, and said injection tool handle contains a straight tube penetrating perpendicular through the center of the small diameter of the handle and the tube extends beyond the surfaces of the handle in both directions of front and back, of which the front portion of the tube extends from the handle to beyond the fingers to provide an ejection point for a plug of putty or filler material into a void to be filled with putty, and the back portion of the tube extends beyond the edge of the handle to provide space for a compression spring which is installed loose fit around the tube and solid shaft assembly, and the opening of the back end of the tube provides an insertion point for a solid shaft which is close fit into the tube to minimize putty slippage around the solid shaft and tube assembly, and such that forward movement of the solid shaft through the tube will eject a plug of putty which will be pressed into the open tip of the tube by the user, and the putty is ejected from the tube when the user pushes forward on the concave knob which is attached to the back end of the exposed solid shaft that is installed into the tube of which said solid shaft is moved in the reverse direction by the compression spring and the solid shaft will be returned back into loading position by the compression spring which was compressed by the user by said action of sliding the solid shaft forward through the tube to expel a plug of putty or filler material.

2. The tool in claim 1 in which the size of the tube and solid shaft can be of different sizes to allow the user to install a small or large diameter plug of putty or filler material.

3. The tool in claim 1 in which the shape of the tube and matching solid shaft can be of different shapes such as round, oval, or rectangular.

4. The tool in claim 1 in which the compression spring is installed to return the solid shaft to loading position.

5. The tool in claim 1 in which a concave shaped knob is installed on the back end of the solid shaft to allow pressing the solid shaft through the tube with sufficient force to eject a plug of putty from the tip of the tube and prevent bodily damage from the back end of the solid shaft, the knob is concave on top to prevent slippage of the person's thumb or finger.

6. The tool in claim 1 in which the compression spring located around the tube and between the handle and knob can be attached to the push knob and handle using adhesive or mechanical attachment, or not attached.

7. The tool in claim 1 in which the knob and the solid shaft can be attached to each other using a screw thread, adhesive, or a press fit.

* * * * *